United States Patent [19]

Koch et al.

[11] Patent Number: 4,920,023

[45] Date of Patent: Apr. 24, 1990

[54] STABLE COLOR DEVELOPER COMPOSITIONS AND PROCESS FOR THE PREPARATION THEREOF

[75] Inventors: Ronald J. Koch, Webster; John F. Knapp, Fairport; Robert J. Gruber, Pittsford, all of N.Y.

[73] Assignee: Xerox Corporation, Stamford, Conn.

[21] Appl. No.: 201,657

[22] Filed: Jun. 2, 1988

[51] Int. Cl.[5] ..... G03G 13/22; G03G 9/10

[52] U.S. Cl. ..... 430/126; 430/108; 430/110; 430/137

[58] Field of Search ..... 430/108, 110, 126, 137

[56] References Cited

U.S. PATENT DOCUMENTS

| | | | |
|---|---|---|---|
| 3,740,334 | 6/1973 | Jacknow et al. | 430/110 |
| 4,265,995 | 5/1981 | Mammino | 430/107 |
| 4,331,756 | 5/1982 | Mayer et al. | 430/108 |
| 4,374,192 | 2/1983 | Mayer et al. | 430/108 |

*Primary Examiner*—Roland E. Martin

*Attorney, Agent, or Firm*—E. O. Palazzo; J. L. Byorick

[57] ABSTRACT

A process for the preparation of stable developer compositions, which comprises treating coated carrier particles with metal salts, or metal salts of fatty acids, and thereafter admixing these particles with a colored toner composition containing metal salts or metal salts of fatty acids, and comprised of resin particles and colored pigment particles, and wherein the salts are present in an amount of from about 0.01 to about 1 percent by weight.

22 Claims, No Drawings

STABLE COLOR DEVELOPER COMPOSITIONS AND PROCESS FOR THE PREPARATION THEREOF

BACKGROUND OF THE INVENTION

This invention is generally directed to developer compositions and processes for formulating stable toner and developer compositions. More specifically, the present invention is directed to a process for obtaining colored toner compositions with stable triboelectric charging values by subjecting the carrier particles to be admixed with the aforementioned toner to treatment, or preconditioning with a metal salt of a fatty acid, or a metal salt. Therefore, in one enbodiment the present invention is directed to a process for the formulation of developer compositions, which comprises treating coated carrier particles, especially ferrites, with metal salts of fatty acids such as zinc stearate; and thereafter admixing the resulting pretreated carrier particles with a toner composition comprised of resin particles, pigment particles, and preferably optional additive particles. The aforesaid carrier pretreatment process step enables in one embodiment of the present invention the resulting negatively charged colored toner compositions to possess substantially identical charging characterisftics, decreased aging over extended time periods, insensitivity to relative humidity, and improved admixing characteristics. Accordingly, the toner and developer compositions of the present invention are particularly useful in permitting the development of colored images in electrophotographic imaging and printing processes. Specifically, thus the developer compositions illustraed herein can be selected for generating colored images while retaining stable trioelectric characteristics. Furthermore, in accordance with the present invention there are provided toner and developer compositions wherein each of the separate colored toner particles, inclusive of cyan, magenta, and yellow, age at substantially the same rate permitting developed prints with the same color intensity beginning wit the first printing or imaging cycle and continuing for an extended number of cycles. Furthermore, the toner compositions of the present invention contain in addition to the treated coated carrier particles, in one important aspect of the present invention, toner particles containing metal salts of fatty acids such as zinc stearate or metal salts, which toners have the improved characteristics as mentioned herein, including excellent charging performance and insensitivity to relative humidity of from about 20 to about 80 percent. Furthermore, the toner and developer compositions of the present invention can be selected for ionographic imaging processes, that is those processes wherein, for example, electroreceptors are selected, reference for example the Delphax 4060 TM commercially available printer.

Numerous different toner and developer compositions are known including those containing styrene butadiene copolymers, reference U.S. Pat. No. 4,469,770, the disclosure of which is totally incorporated herein by reference. Also, toners with acceptable admixing characteristics are illustrated in U.S. Pat. No. 4,524,120, the disclosure of which is totally incorporated herein by reference, wherein the carrier selected for admixing with the aforementioned toner contains a continuous polymer coating thereover having incorporated therein a fluoropolymer.

Futhermore, there is described in a number of patents the selection of metal salts and metal salts of fatty acids as external additives for toner compositions, reference for example U.S. Pat. No. 3,590,000, the disclosure of which is totally incorporated herein by reference, which illustrates the use of, for example, zinc stearate as an external additive for toner compositions; 3,655,374; and 3,983,045, the disclosures of which are totally incorporated herein by reference.

Of particular interest are the teachings in U.S. Pat. Nos. 4,331,756 and 3,740,334. In the '756 patent there are disclosed developer compositions with toners and carriers containing thereover certain coatings such as mixtures of butadiene acrylonitrile rubber, reference column 4, lines 1 to 11, for example. In column 2, lines 33 to 46, of this patent it is indicated that if it were possible to coat the carrier with zinc stearate, the characteristics thereof would remain constant, see column 2, line 41. At line 43 in column 2, it is indicated that as a practical matter this is not possible since the abrasive action of the constantly moving developer continuously removes the zinc stearate. In the '334 patent, column 7, lines 68 to 75, for example, it is indicated that the metal salts may be tumbled or milled with the toner or carrier particles or intimately dispersed in each toner or carrier particle. Also, in column 8, lines 36 to 38, it is indicated that the metal salt of a higher fatty acid can be physically mixed with or applied as a coating on the toner or carrier particles, preferably in an amount of about 0.02 to about 10 percent. Also of interest in U.S. Pat. No. 4,374,192, a divisional of the aforesaid 4,331,756 patent; and U.S. Pat. No. 4,265,995.

Additionally, the Xerox Corporation 6500® copying machine selects separate toner compositions, inclusive of a magneta toner composition, a cyan toner composition, and a yellow toner composition. It is known that in some instances with the 6500® images of poor copy quality result. Thus, these images have undesirable background deposits, and low densities unless the bias on the developer mixtures is adjusted, resulting from different triboelectric charging properties as each of the colored toner compositions age. This problem is eliminated with the toner compositions of the present invention in that there can be achieved substantially similar stable triboelelectric charging characteristics for the colored toner compositions primarily as a result of the presence of the pretreated carrier particles. Furthermore, only a limited number of useful colored pigments are available, therefore, substantial efforts have been consumed in affecting adjustments to the aforementioned colored toner compositions for enabling improved copy quality with extended usage.

Accordingly, there continues to be a need for the formulation of stable toner, and developer compositions. More specifically, there is a need for negatively charged toner compositions, and processes that will enable the preparation of electrically stable toner compositions. There is also a need for processes of formulating colored toner compositions wherein each of the separate toners generated are of substantially equal triboelectric charging values. Further, there is a need for colored toner compositions wherein the resulting separate toners generated do not significantly age with an extended number of copy cycles. Additionally, there is a need for magenta, cyan, yellow; highlight colors such as red, blue, and green; toner compositions with similar triboelectric charging characteristics; and wherein these characteristics are maintained for an extended number of imging cycles. There is also a need for colored toner compositions with improved stable electrical properties thereby enabling substantially similar color intensities for an extended number of imaging cycles. Moreover, there is a need for negatively charged colored toner compositions with rapid admix charging times of, for example, less than one minute, and preferably less than about 30 seconds. Furthermore, there is a need for negatively charged colored toner compositions with a stable constant triboelectric charge thereon of from about 15 to about 35 microcoulombs per gram. Moreover, there is a need for negatively charged colored toner compositions which are insensitive to relative humidity, and possess improved admix charging characteristics, which toner compositions contain metal salts or metal salts of fatty acids, and wherein the coated carrier particles also include metal salts or metal salts of fatty acids, particularly zinc stearate.

SUMMARY OF THE INVENTION

It is an object of the present invention to provide colored toner compositions with many of the advantages indicated herein.

In another object of the present invention there are provided electrically stable colored toner and developer compositions; and processes for the preparation thereof.

In still another object of the present invention there are provided different colored toner compositions with relatively equivalent electrical characteristics for an extended number of imaging cycles in xerographic printing and xerographic imaging systems.

In yet another object of the present invention there are provided colored toner compositions that maintain their triboelectric charging values for an extended number of imaging cycles in xerographic printing, and xerographic imaging processes; and wherein the carrier particles selected are initially treated, or preconditioned with components such as metal salts of fatty acids including zinc stearate.

Also, in a further object of the present invention there are provided magenta, yellow, and cyan toner compositions that maintain their triboelectric charging values for an extended number of imaging cycles in xerographic printing, and xerographic imaging processes; and wherein the carrier particles selected are initially treated with components such as zinc stearate.

Another object of the present invention resides in the provision of colored toner compositions with triboelectric charging values of about −15 to about −35 microcoulombs per gram beginning with the first imaging cycle, and continuing on to an extended number of imaging cycles exceeding, for example, 250,000; and which toners possess excellent admix charging characteristics of, for example, less than 1 minute.

Further, another object of the present invention resides in the provision of colored toner compositions with negative triboelectric charging values, and wherein the toners and developers thereof are insensitive to relative humidity of from about 20 to about 80 percent.

It is an additional object of the present invention to provide colored electrostatic latent imaging processes with colored toners prepared by the process illustrated herein.

Also, in another object of the present invention there are provided negatively charged colored developer compositions comprised of toner compositions with certain resins, and carrier particles with particular coatings thereover, which carriers are preconditioned with minor amounts of metal salts, or metal salts of fatty acids.

In another object of the present invention there are provided developer compositions with coated carrier particles that have been treated with metal salts or metal salts of fatty acids, and which compositions can be selected for ionographic imaging processes inclusive of generating images of excellent resoluton in the Delphax 4060 TM printing apparatus.

These and other objects of the present invention are accomplished by providing colored toner, and developer compositions. More specifically, in accordance with the present invention there are provided developer compositions comprised of resin particles, and colored pigment particles. Thus, in one embodiment of the present invention there are provided electrical stable colored toner compositions containing treated carrier particles admixed with toner compositions with metal salts, or metal salts of fatty acids, and containing toner resin particles comprised of styrene acrylates, styrene methacrylates, styrene butadienes, or mixtures thereof; and a colorant selected from the group consisting of cyan, magenta, yellow, red green, blue, brown, or mixtures thereof; and wherein said carrier particles comprised of a core containing a polymeric coating thereover, and present on the surface thereof of metal salts, or metal salts of fatty acids, especially zinc stearate.

In one aspect of the present invention, polymeric coated carrier particles are subjected to blending with metal salts, or metal salts of fatty acids, such as zinc stearate, wherein a coating thereof is formed on the surface. There results on the carrier coating the aforesaid salts in an amount of from, for example, about 0.01 to about 1 percent, and preferably from about 0.01 to about 0.1 percent. Subsequently, the resulting coated carrier particles are admixed with toner compositions.

There are also provided, in accordance with the present invention, processes for permitting the development of colored electrophotographic latent images, which comprises formulating the aforementioned image on a photoconductive member, followed by the development thereof with the developer compositions illustrated herein. Additionally, the developer compositions of the present invention may be useful for enabling the achievement of colored images in known printing processes. Subsequent to development, the images can be transferred to a suitable substrate such as paper, followed by fixing thereto with heat or other similar fixing processes.

An important aspect of the present invention thus resides in the pretreatment of the carrier particles with a metal salt, or a metal salt of a fatty acid such as zinc stearate.

Illustrative examples of resins useful for the toner compositions of the present invention include polyesters, styrene/butadienes, styrene copolymers such as styrene/methacrylates, styrene and acrylates, vinyl resins, and polymeric esterification products of a diacarboxylic acid, and a diol comprising a diphenol. Suitable vinyl resins include homopolymers or copolymers of two or more vinyl monomers. Examples of vinyl monomeric units are styrene, p-chlorostyrene, ethylenically unsaturated mono-olefins such as ethylene, propylene, butylene and isobutylene; vinyl esters such as vinyl acetate; esters of alphamethylene aliphatic monocarboxylic acids, inclusive of methyl acrylate, ethyl acrylate and butyl methacrylate; acrylonitrile, methacrylonitrile,and acrylamine; and vinyl ethers such as vinyl methyl ether, vinyl isobutyl ether, and mixtures thereof. Also, there can be selected as toner resins styrene butadienes with a high percentage of styrene, reference U.S. Pat. No. 4,469,770, the disclosure of which is totally incorporated herein by reference.

Preferred polymeric resins for the toners of the present invention are styrene methacrylates, styrene acrylates, styrene butadienes, and polyester resins such as those described in U.S. Pat. Nos. 3,655,374 and 3,590,000, the disclosures of which are totally incorporated herein by reference; polyester resins resulting from the condensation of dimethylterephthalate, 1,3 butanediol, and pentaerythritol; and Pliolite resins which are commercially available from Goodyear Corporation as S5A. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent.

Illustrative examples of magenta, cyan and yellow pigments, or colorants selected for the toner compositions of the present invention are well known, including, for example, the magenta compounds 2,9-dimethyl-substituted quinacridone, an anthraquinone dye identified in the Color Index as Cl 60710; Hostaperm Pink; Cl Dispersed Red 15, a diazo dye identified in the Color Index as Cl 16050; Cl Solvent Red 19; and the like. Examples of cyan materials that may be used as pigments include copper tetra-4(octadecyl sulfonamido)phthalocyanine; X-copper phthalocyanine pigment, listed in the Color Index as Cl 74160; Cl Pigment Blue; Sudan Blue; and Anthrathrene Blue, identified in the Color Indes as Cl 69810; Special Blue X-2137; and the like; while illustrative examples of yellow pigments that may be selected include diarylide yellow 3,3-dichlorobenzidene acetoacetanilides; a monazo pigment identified in the Color Index as Cl 12700; Cl Solvent Yellow 16, a nitrophenyl amine sulfonamide identified in the Color Index as Foron Yellow Se/GLN; Cl Dispersed Yellow 33; 2,5-dimethoxy-4-sulfonanilide phenylazo-4'-chloro-2,5-dimethoxy aceto-acetanilide; and Permanent Yellow FGL. Other colorants include red, green, blue, brown, Fachen Red, Lithol Scarlet, and mixtures thereof. These colorants are generallly present in the toner composition in an amount of from about 2 weight percent to about 15 weight percent based on the weight of the toner resin particles.

Also, incorporated as additive components for the toner compositions of the present invention are various additives including flow aid components such as colloidal silicas, reference U.S. Pat. Nos. 3,720,617 and 3,900,588, the disclosure of each of these patents being totally incorporated herein by reference. Generally, from about 0.1 percent by weight to about 1 percent by weight, and preferably about 0.50 percent by weight of silica, such as Aerosil R972 or R976, is incorporated into or on the surface of the colored toner compositions of the present invention.

As second surface additives, there can be selected for the colored toner compositions of the present invention metal salts or metal salts of fatty acids, inclusive of zinc stearate, reference U.S. Pat. No. 3,983,045, the disclosure of which is totally incorporated herein by reference. These metal salts are generally present in an amount of from about 0.1 percent by weight to about 1 percent by weight, and preferably in an amount of from about 0.35 percent by weight. Furthermore, the aforementioned salts are selected for the treatment, or preconditioning of the carrier particles.

In one important embodiment of the present invention, the developer composition is comprised of the toner composition containing styrene methacrylates, styrene acrylates, or styrene butadiene resin particles, colored pigment particles, and present on the surface thereof, additive particles of metal salts or metal salts of fatty acids, such as zinc stearate, in the amount indicated herein; and coated carrier particles, which have been pretreated with a metal salt or metal salts of fatty acids. Processes for the preparation of the aforementioned developer compositions are also encompassed within the scope of the present invention, which process comprises the preparation of stable developer compositions, which comprises treating coated carrier particles with metal salts, or metal salts of fatty acids, and thereafter admixing these particles with a colored toner composition containing metal salts of fatty acids, and comprised of styrene methacrylates, styrene acrylates, and styrene butadiene resin particles, or other resins, and colored pigment particles; and wherein the salts are present in an amount of from about 0.01 to about 1 percent by weight.

Formulation of developers comprises admixing the treated carrier particles with the aforementioned toner compositions. As carrier cores there can be selected steel, nickel, iron, ferrites, and the like. Additionally, there can be selected nickel berry carriers as described in U.S. Pat. Nos. 3,847,604 and 3,767,598, the disclosures of which are totally incorporated herein by reference. The diameter of the carrier particles is from about 50 microns to about 1,000 microns, thus premitting the carrier particles to possess sufficient density and inertia to avoid adherence to the electrostatic images during the development process. Moreover, the carrier particles prior to treatment are coated with known components such as terpolymers of styrene, reference U.S. Pat. Nos. 3,467,634 and 3,526,533, the disclosures of which are totally incorporated herein by reference, polymethacryltes, styrene acrylates, or mixtures thereof, which coating is generally present in an amount of from about 0.01 to about 3 percent by weight. Preferably, the coating is semicontinuous and is present in an amount of about 1 percent by weight of the carrier, that is for example per 100 grams of carrier 1 gram of zinc stearate is selected (1 weight percent). Also, there can be present in the carrier coating, prior to the preconditioning, conductive particles such as carbon blacks, inclusive of Regal, Vulcan, mixtures thereof, and the like.

The carrier particles are mixed with the toner composition in various suitable combinations, however, best results are obtained with from about 1 part by weight of toner particles to about 3 parts by weight of toner particles, to about 100 parts to 200 parts by weight of carrier particles.

The toner compositions can also contain mixtures of resin particles, such as, for example, from about 10 to about 90 percent by weight of first resin particles, and about 90 to about 10 percent by weight of second resin particles, which resins are selected from those illustrated herein. More specifically, in one preferred embodiment the toner composition is comprised of from about 45 to about 55 percent by weight of first resin particles of styrene butadienes, and from about 55 to about 45 percent by weight of second resin particles of styrene methacrylates. Furthermore, the toner particles of the present invention usually possess an average particle size diameter of from about 5 to about 10 microns.

The developer compositions of the present inventon possess many advantages primarily because of the preconditioning with the metal salts, inclusive of a stable triboelectric charge of from about −15 to about −35 microcoulombs per gram; admix times of from about 15 to about 30 seconds in some embodiments; and insensitivity to relative humidities of from about 20 to abot 80 percent.

Examples of imaging members that may be selected for use with the toner and developer compositions of the present invention include various known photoreceptors, such as selenium; selenium alloys, inclusive of selenium aresenic, selenium tellurium, selenium arsenic tellurium; selenium with halogens therein; and halogen doped selenium alloys. Also, positively charged toners can be selected for the development of images present on layered photoresponsive devices, reference U.S. Pat. No. 4,265,990, the disclosure of which is totally incorporated herein by reference. With layered members, discharge area development is selected.

Of importance with respect to the present invention is the preconditioning of the coated carrier particles with salts such as zinc stearate, which salts are usually present as a semicontinuous or continuous manner in an amount of from about 0.01 to 0.1 percent by weight, as determined by ESCA.

The following examples are being supplied to further define specific embodiments of the present invention, it being noted that these examples are intended to illustrate and not limit the scope of the present invention. Parts and percentages are by weight unless otherwise indicated.

EXAMPLE I

A toner composition was prepared by blending in a Banbury rubber mill, followed by micronization, 46.0 percent by weight of a styrene butadiene resin, commercially available from Goodyear as Pliolite; 46.5 percent by weight of a styrene n-butyl methacrylate resin (58/42); and 7.5 percent by weight of Sudan Blue pigment. Thereafter, there was added as external components to the formulated toner 0.2 percent by weight of Aerosil R976, and 0.5 percent by weight of zinc stearate. Subsequent to attrition and classification, there resulted toner particles with an average volume diameter of 6.5 microns as determined by a Coulter Counter.

Subsequently, the above prepared toner, 2.5 parts by weight, were admixed with 100 parts by weight of carrier particles, 100 microns in diameter comprised of a smooth rounded ferrite core containing a coating thereover, 0.6 percent by weight of a terpolymer of styrene, methacrylate, and an organo triethoxy silane, reference U.S. Pat. No. 3,526,533, the disclosure of which is totally incorporated herein by reference, which coating contained therein 20 percent by weight of Vulcan carbon black particles. The coated carrier particles were blended, 0.1 percent by weight of zinc stearate, permitting the formation of a semicontinuous coating of the stearate on the polymer coating.

There resulted on the toner a triboelectric charge of −20 microcoulombs per gram as determined in Faraday Cage apparatus, which charge remained at −20 for 250,000 imaging cycles in a xerographic imaging test fixture with a photoconductor comprised ofa selenium (99 percent) arsenic (0.1) alloy. In contrast, an identical developer composition, with the exception that the carrier was not treated with zinc stearate, had a triboelectric charge on the toner of a −40 microcoulombs per gram beginning with the first developed copy and continuing on to 40,000 copies, where it dropped to a −25 microcoulombs per gram.

EXAMPLE II

A developer composition was prepared by repeating the procedure of Example I with the exception that there was selected 7.5 percent by weight of the Sudan Blue, 92.5 percent by weight of the styrene n-butyl methacrylate copolymer resin, 0 percent of the styrene butadiene, 0.3 percent of the R976, and 0.5 percent of the zinc stearate for the toner composition. Substantially similar results were obtained. Also, the toner had an admix changing time of 15 seconds as determined in a charge spectrograph.

EXAMPLE III

A developer composition was prepared by repeating the procedure of Example I with the exception that there was selected 7.5 percent of the yellow pigment FGL in place of the 7.5 percent Sudan Blue, and substantially similar results were obtained. The toner of this Example had an admix charging time of 20seconds, and a triboelectric charge on the toner of a −28 microcoulombs per gram.

EXAMPLE IV

Toner and developer compositions were prepared by repeating the procedure of Example I with the exception that there was selected 5 percent of Hostaperm Pink in place of the Sudan Blue, 5 percent of a styrene n-butyl methacrylate copolymer resin (65/35), 90 percent of the styrene butadiene copolymer, 0.2 percent of R976, and 0.5 percent of zinc stearate for the toner composition; and substantially similar results were obtained. The toner had a triboelectric charge thereon of a −21 microcoulombs per gram, and an admix charging time as determined in the charge spectrograph of 30 seconds.

EXAMPLE V

Toner and developer compositions were prepared by repeating the procedure of Example I with the exception that the coated carrier particles contained no zinc stearte thereon. Specifically, there were prepared cyan, yellow, and magneta toners wherein the carrier particles contain zinc stearate on the polymer carrier coating, reference the above Examples, and with no zinc stearate on the coating, with the following results.

| | NO ZINC STEARATE | | WITH ZINC STEARATE | |
|---|---|---|---|---|
| TONER | TRIBO | ADMIX (seconds) | TRIBO | ADMIX (seconds) |
| Cyan | −34 | 60 | −28 | 0.25 |
| Yellow | −40 | 60 | −28 | 0.25 |
| Magenta | −25 | 60 | −18 | 0.25 |

The yellow developer of Example IV, 2 percent toner concentration, after 15 minutes at a relative humidity of 80 percent, and a temperature of 80° F., had a triboelectric charge of a −17. Also, this toner had a tribo of −17 at a relative humidity of 55° and at 72° F.; and −17 at a relative humidity of 20° and at 60° F. In contrast, a developer wherein the carrier was not trated with zinc stearate had tribos of −21 at 80 percent relative humidity and 80° F.; −40 at 55 percent relative humidity and 72° F.; and about −50 at 20 percent relative humidity and 60° F.

The above relative humidity sensitivity test was repeated with respect to the magenta developerof Example II, 2 percent toner concentration. At 80 percent relative humidity and 80° F., the tribo was (triboelectric charge throughout is in microcoulombs per gram) −22, and the tribo was also a −22 at 55 relative humidity and 72° F., and −19 microcoulombs per gram at 20 percent relative humidity and 60° F. In contrast, with the same developer containing no zinc stearate on the carrier coating the tribo was −12, −25 and −35, respectively.

With the cyan developer of Example III, the tribo was −24, −28 and −32 at 80 percent relative humidity and 80° F., 55 percent relative humidity and 72° F., and 20 percent relative humidity and 60° F., respectively, as compared to −17, −35 and −40 microcoulombs per grams wherein the carrier coating contained no zinc stearate.

With further respect to the present invention, and particularly with regard to treating the carrier coatings with the metal salts or metal salts of fatty acids such as zinc stearate, in one embodiment there was selected about 20 pounds of the ferrite carrier core of Example I, which core is mixed in a Lodige blender for about two hours with zinc stearate present in a concentration of about 0.01 to about 0.1 percent.

Other modifications of the present invention will occur to those skilled in the art subsequent to a review of the present application. These modifications, including equivalents thereof, are intended to be included within the scope of this invention.

What is claimed is:

1. A process for the preparation of stable developer compositions, which comprises treating coated carrier particles with metal salts, or metal salts of fatty acids, and thereafter admixing these particles with a colored toner composition containing metal salts or metal salts of fatty acids, and comprised of resin particles and colored pigment particles; and wherein the salts are present on the carrier particles in an amount of from about 0.01 to about 1 percent by weight.

2. A process for the preparation of stable developer compositions, which comprises blending coated carrier particles with metal salts or metal salts of fatty acids, thereby permitting the formation of a salt coating thereover, and thereafter admixing these particles with a colored toner composition comprised of resin particles and colored pigment particles selected from the group consisting of magenta, yellow, cyan, red, brown, and mixtures thereof, and metal salts or metal salts of fatty acids.

3. A process in accordance with claim 1 wherein the resin is selected from the group consisting of styrene acrylates, styrene methacrylates, and styrene butadiene polymers.

4. A process in accordance with claim 2 wherein the styrene methacrylate is styrene/n-butyl methacrylate.

5. A process in accordance with claim 1 wherein the pigments are selected from the group consisting of magenta, yellow, and cyan.

6. A process in accordance with claim 1 wherein the pigments are present in an amount of from about 1 percent by weight to about 15 percent by weight.

7. A process in accordance with claim 1 wherein the metal salt of a fatty acid is zinc stearate.

8. A process in accordance with claim 2 wherein the metal salt of a fatty acid is zinc stearate.

9. A process in accordance with claim 1 wherein the carrier core is comprised of ferrites.

10. A process in accordance with claim 2 wherein the carrier core is comprised of ferrites.

11. A process in accordance with claim 1 wherein the toner composition contains as external additives colloidal silica, and metal salts, or metal salts of fatty acids.

12. A process in accordance with claim 2 wherein the toner composition contains as external additives colloidal silica, and metal salts, or metal salts of fatty acids.

13. A process in accordance with claim 12 wherein the toner resin is selected from the group consisting of styrene acrylates, styrene methacrylates, and styrene butadiene polymers.

14. A process in accordance with claim 13 wherein the styrene methacrylate is styrene n-butyl methacrylate.

15. A process in accordance with claim 12 wherein the pigments are selected from the group consisting of magenta pigments, yellow pigments, and cyan pigments.

16. A process in accordance with claim 15 wherein the pigments are present in an amount of from about 1 percent by weight to about 15 percent by weight.

17. A process in accordance with claim 1 wherein the triboelectric charge on the toner is from about 15 to about 35 microcoulombs per gram.

18. A process in accordance with claim 1 wherein the triboelectric charge on the toner is about 20 microcoulombs per gram beginning with the first developed copy and continuing for 500,000 imaging cycles.

19. A method for developing latent images, which comprises forming an electrostatic latent image on a photoconductive imaging member, contacting the image with the toner composition obtained by the process of claim 1, followed by transferring the image to a suitable substrate, and permanently affixing the image thereto.

20. A method of imaging in accordance with claim 19 wherein the toner pigments are selected from the group consisting of magenta, yellow, and cyan.

21. A method of imaging in accordance with claim 19 wherein the pigments are present in an amount of from about 1 percent by weight to about 15 percent by weight.

22. A method of imaging in accordance with claim 19 wherein there is selected for the carrier coating zinc stearate.

* * * * *